US009233460B2

(12) United States Patent
Liptak et al.

(10) Patent No.: US 9,233,460 B2
(45) Date of Patent: Jan. 12, 2016

(54) CONTROL ELEMENT FOR A HAND POWER TOOL

(75) Inventors: Csaba Liptak, Miskolc (HU); Csaba Levai, Miskolc (HU)

(73) Assignee: Robert Bosch GmbH, Stuttgart (DE)

( * ) Notice: Subject to any disclaimer, the term of this patent is extended or adjusted under 35 U.S.C. 154(b) by 701 days.

(21) Appl. No.: 13/578,830

(22) PCT Filed: Feb. 3, 2011

(86) PCT No.: PCT/EP2011/051522

§ 371 (c)(1),
(2), (4) Date: Aug. 14, 2012

(87) PCT Pub. No.: WO2011/101253

PCT Pub. Date: Aug. 25, 2011

(65) Prior Publication Data

US 2012/0305276 A1 Dec. 6, 2012

(30) Foreign Application Priority Data

Feb. 16, 2010 (DE) ..... 10 2010 001 967

(51) Int. Cl.
*B25F 5/00* (2006.01)

(52) U.S. Cl.
CPC ..... *B25F 5/00* (2013.01)

(58) Field of Classification Search
CPC ..... H03M 1/22; B25F 5/00
USPC ..... 173/47, 216, 217; 341/11
See application file for complete search history.

(56) References Cited

U.S. PATENT DOCUMENTS

| | | | | |
|---|---|---|---|---|
| 4,806,837 | A * | 2/1989 | Ito | 318/653 |
| 4,901,072 | A * | 2/1990 | Fox | 341/10 |
| 5,739,775 | A * | 4/1998 | Brandestini | 341/10 |
| 5,748,112 | A * | 5/1998 | Glonner | 341/17 |
| 6,043,483 | A * | 3/2000 | Schreiber | 250/231.13 |
| 6,484,814 | B2 * | 11/2002 | Bongers-Ambrosius | 173/2 |
| 7,612,689 | B2 * | 11/2009 | Neumann et al. | 341/11 |
| 2002/0096343 | A1 | 7/2002 | Potter et al. | |
| 2009/0098971 | A1 * | 4/2009 | Ho et al. | 475/153 |
| 2009/0200053 | A1 | 8/2009 | Scrimshaw et al. | |

FOREIGN PATENT DOCUMENTS

| | | | |
|---|---|---|---|
| CN | 1370661 | A | 9/2002 |
| CN | 1830631 | A | 9/2006 |
| CN | 101377229 | A | 3/2009 |
| CN | 101468464 | A | 7/2009 |
| EP | 2 077 177 | A1 | 7/2009 |

OTHER PUBLICATIONS

International Search Report corresponding to PCT Application No. PCT/EP2011/051522, mailed May 17, 2011 (German and English language document) (6 pages).

* cited by examiner

*Primary Examiner* — Nathaniel Chukwurah
(74) *Attorney, Agent, or Firm* — Maginot, Moore & Beck LLP

(57) ABSTRACT

An electric hand power tool includes a cylindrical device section, a control element displaceable about the cylindrical device section, and an electric scanning device disposed at the device section and configured to determine a rotary position of the control element. The scanning device is configured to optically scan the rotary position.

12 Claims, 3 Drawing Sheets

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| LSB | | ■ | ■ | | | ■ | ■ | | | ■ | ■ | | | ■ | ■ | |
| | | | ■ | ■ | ■ | ■ | | | | | ■ | ■ | ■ | ■ | | |
| | | | | | ■ | ■ | ■ | ■ | ■ | ■ | ■ | ■ | | | | |
| MSB | | | | | | | | | ■ | ■ | ■ | ■ | ■ | ■ | ■ | ■ |

CONTROL ELEMENT FOR A HAND POWER TOOL

This application is a 35 U.S.C. §371 National Stage Application of PCT/EP 2011/051522, filed on Feb. 3, 2011, which claims the benefit of priority to Serial No. DE 10 2010 001 967.4, filed on Feb. 16, 2010 in Germany, the disclosures of which are incorporated herein by reference in their entirety.

BACKGROUND

Electric hand power tools often comprise an electric drive motor which causes a tool or tool holder to rotate by means of a transmission. An energy supply for the electric hand power tool can be provided using an energy store connected to the hand power tool, for example a battery or rechargeable battery, or by an electric supply network, for instance, via an electric supply line.

In order to be able to make the electric hand power tool as compact as possible, control elements are preferably designed in such a manner that they only slightly change an outer contour of the electric hand power tool. This ensures accessibility of the electric hand power tool to workpieces, even under restricted spatial conditions.

For this purpose, a control element which can be moved substantially around the drive train in a rotating or pivoting movement is occasionally provided in the region of the often cylindrical drive train. Such a control element is usually electrically scanned using a sliding contact which is fastened to the control element and opens or closes contacts of a scanning printed circuit board according to a rotary position of the control element. The scanning printed circuit board extends substantially in a plane perpendicular to the axis of rotation of the control element and is limited in the radial direction, on the inside and outside, by a circle line.

Production and mounting of the scanning printed circuit board are complicated, which may increase production costs of the electric device. Furthermore, the contacts and the sliding contact are exposed to moisture and dirt which may arise in the region of the electric hand power tool.

The disclosure is based on the object of specifying an electric hand power tool having an improved scanning apparatus.

SUMMARY

The disclosure solves this problem with an electric hand power tool having the features of the disclosure.

An electric hand power tool comprises a cylindrical device section, a control element which is movable around the cylindrical device section, and an electric scanning apparatus which is arranged on the device section and is intended to determine a rotary position of the control element, the scanning apparatus being set up to optically scan the rotary position.

Disturbing influences caused by moisture, dust and vibrations, which may be present in the region of the hand power tool, are advantageously effectively suppressed by the optical scanning.

The scanning apparatus may comprise a plurality of binary scanning elements, each of which provides a binary digit of a binary coded representation of the rotary position. This makes it possible to directly determine an absolute rotary position with high resolution by means of a minimum number of scanning elements. The rotary position determined in this manner can be advantageously digitally processed further without further conversion, for example by means of an integrated digital controller.

In this case, the rotary position may be coded in such a manner that the binary representations of respective adjacent rotary positions of the control element differ in at most one binary digit. In contrast to a conventional dual code or BNC code, such highly differing incorrect measurements, which may arise if a plurality of binary digits change between two adjacent rotary positions, are avoided, but this takes place only with a certain angular offset, for example on account of imperfections in the structure of the control element with the scanning elements. If a measurement takes place within the angular offset, an incorrect measurement can be carried out with an error which may amount to the most significant binary digit, which may correspond to half the range of values of the scanning apparatus. As a result of the coding according to the disclosure, an incorrect measurement may amount, at most, to the value of the difference between adjacent rotary positions, which usually corresponds to the least significant binary digit.

The control element may have a number of position markings in the shape of a circular arc, each scanning element being set up to scan a position marking assigned to it, and at least two position markings being on the same circumference around the axis of rotation of the control element. This advantageously makes it possible to increase a resolution of the coded rotary position of the control element without using additional installation space or makes it possible to reduce a mechanical extent of the control element with the same resolution.

For this purpose, a coding disk which extends in the radial direction with respect to the axis of rotation of the control element may be connected to the control element. The position markings may be in the form of apertures or reflective marks in/on the coding disk. The scanning elements may comprise light barriers or reflection light barriers. It is possible to use visible or invisible light, for example infrared light, and the light may be modulated in order to suppress interference caused by extraneous light. The reflective marks may be arranged on different sides of the coding disk. This advantageously makes it possible to save further installation space in the radial direction of the coding disk, with the result that the electric hand power tool can be even more compact.

The electric hand power tool may comprise a controller which is designed to control an electric drive device of the hand power tool on the basis of the rotary position of the control element. This advantageously makes it possible for a user of the hand power tool to control, in particular, a rotational speed of the drive device and/or a torque of the drive device in an intuitive manner. The controller may be arranged, together with the scanning elements, on a common flat printed circuit board. This makes it possible to avoid connecting special components, thus making it possible to reduce production costs for the electric hand power tool.

The cylindrical device section may comprise an electric motor and/or a planetary transmission of the hand power tool. The control element and possibly the controller may be integrated with the electric motor and/or the planetary transmission, thus forming a universal drive assembly which can be used in a multiplicity of different electric hand power tools.

The control element may be movable around an axis of rotation which extends parallel to a longitudinal axis of the cylindrical device section. In this case, the axis of rotation may coincide with the longitudinal axis or may run with an offset with respect to the latter. The movability of the control element may thus be adapted to a contour of a housing which surrounds the cylindrical device section.

BRIEF DESCRIPTION OF THE DRAWINGS

The disclosure is now described in more detail with reference to the accompanying figures, in which.

DETAILED DESCRIPTION

Figure 1:
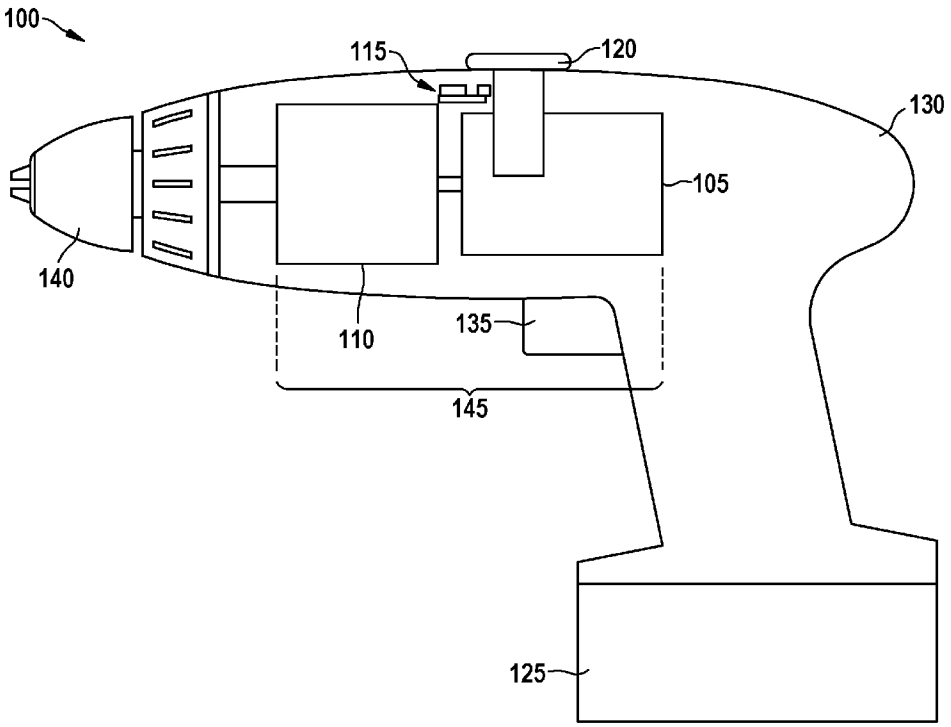
FIG. 1 shows a schematic illustration of a cordless screwdriver.

FIG. 1 shows a schematic illustration of a cordless screwdriver 100. The cordless screwdriver 100 illustrated is representative of any desired electric hand power tool; other embodiments may also include, for example, a drill, a lighting device or a measuring instrument having a cylindrical device section with a corresponding control element. The cordless screwdriver 100 comprises an electric drive motor 105, a planetary transmission 110, an electronic controller 115, a control element 120 and a rechargeable battery 125, which are arranged in a housing 130 of the cordless screwdriver 100. In addition, a tripping device 135 and a drill chuck 140 on the cordless screwdriver 100 are accessible from the outside.

Depending on a position of the control element 120 and of the tripping device 135, the electronic controller 115 provides a flow of electrical energy from the rechargeable battery 125 to the electric drive motor 105. The torque output by the electric drive motor 105 is transmitted to the planetary transmission 110 and from there to the drill chuck 140. The drill chuck 140 is set up to receive a tool, for example a drill or a milling cutter to which the rotation of the drill chuck 140 is transmitted. The electric drive motor 105 and the planetary transmission 110 form the drive device 145.

In other embodiments of the cordless screwdriver 100, the rechargeable battery 125 is at a different position, with the result that the housing 130 has as compact and ergonomic a shape as possible, for example substantially rotationally elliptical or cylindrical.

Figure 2:
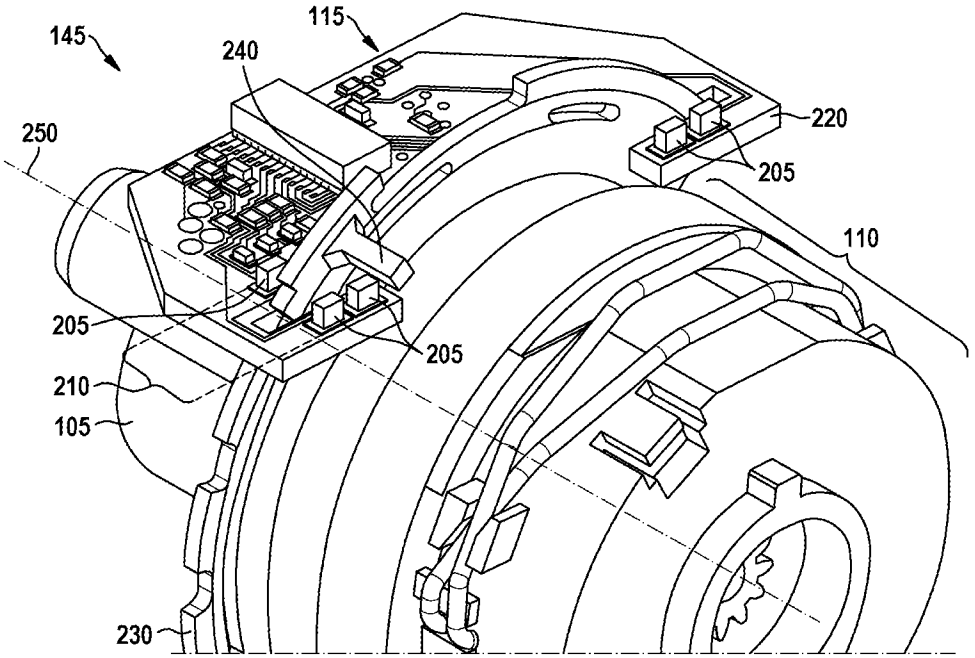
FIG. 2 shows an isometric view of the drive device of the cordless screwdriver from FIG. 1.

FIG. 2 shows an isometric view of the drive device 145 of the cordless screwdriver 100 from FIG. 1. The electric drive motor 105 and the planetary transmission 110 extend along a common axis of rotation 250. The electronic controller 115 is arranged on a printed circuit board 220, the printed circuit board 220 carrying light barrier elements 205. The light barrier elements 205 scan a coding disk 230 which is arranged coaxially with respect to the electric drive motor 105 and the planetary transmission 110 in a manner rotatable around the axis of rotation 250. The coding disk 230 extends substantially in a direction radial to the axis of rotation 250 and comprises a driver 240 which runs parallel to the axis of rotation 250 and is intended to engage with the control element 120 from FIG. 1.

A further light barrier element 205 is arranged opposite each of the light barrier elements 205 on the respective opposite side of the coding disk 230. Two light barrier elements 205 in each case form a light barrier 210 which scans the coding disk 230 at a predetermined radial distance from the axis of rotation 250.

In the embodiment illustrated, the coding disk 230 has recesses which allow or do not allow light to pass between light barrier elements 205 of a light barrier 210 depending on the rotary position of the coding disk 230. In another embodiment, the coding disk 230 may also have reflective marks instead of recesses, and the light barriers 210 may each be completely on one of the sides of the coding disk 230 in order to scan the reflective marks.

The coding disk 230 is mounted and guided in grooves in the housing 130 from FIG. 1. The driver 240 engages in the control element 120 from FIG. 1 in such a manner that a pivoting movement of the control element 120 around the axis of rotation 250 is transmitted to the coding disk 230.

Figure 3:
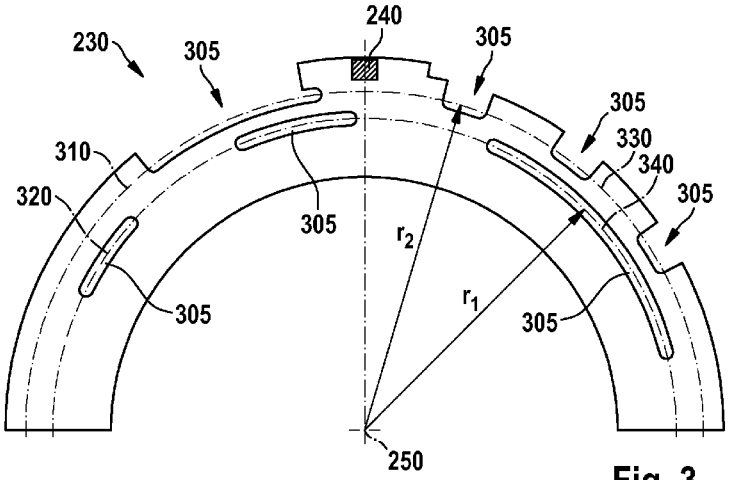
FIG. 3 shows a plan view of the coding disk from FIG. 2.

FIG. 3 shows a plan view of the coding disk 230 from FIG. 2 along the axis of rotation 250. The coding disk 230 has a number of recesses 305 which run on circular paths with different radii r1 and r2 around the axis of rotation 250. Along the circular paths around the radii r1 and r2, the recesses 305 are arranged in such a manner that they allow or do not allow light from the light barrier elements 205 to pass depending on the rotary position of the coding disk 230 with respect to the printed circuit board 220 from FIG. 2. The coding disk extends at an angle of approximately 180° around the axis of rotation 250. The maximum angle of rotation of the coding disk 230 from FIG. 3 is below 90°, with the result that an outer left-hand track 310, an inner left-hand track 320, an outer right-hand track 330 and an inner right-hand track 340 result with respect to the driver 240, which tracks are each scanned by different light barriers 210 from FIG. 2.

In a further embodiment, reflective markings may also be applied along the tracks 310 to 340 instead of recesses 305, and the light barriers 210 constructed from the light barrier elements 205 may be reflection light barriers. Mutually corresponding light barrier elements 205 are then always on the same side of the coding disk 230. Different tracks corresponding to the tracks 310 to 325 may be opposite one another on the front side and rear side of the coding disk 230. The coding disk 230 may be scanned from each side using, for example, four light barriers each comprising two light barrier elements 205, which increases a resolution of the determined rotary position by a factor of $2^4=16$. Alternatively, four tracks analogous to the tracks 310 to 325 may be scanned, for example, using two reflection light barriers on each side of the coding disk 230, all four tracks having the same radius with respect to the axis of rotation of the coding disk 230.

Figure 4:
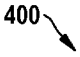
FIG. 4 shows an assignment table between rotary positions and states of the scanning apparatuses from FIG. 2.

FIG. 4 shows an assignment table 400 between rotary positions of the coding disk 230 and states of the light barrier elements 205 or light barriers 210 from FIG. 2. 16 rotary positions of the coding disk 230 from FIGS. 2 and 3 and of the control element 120 from FIG. 1 are provided in a horizontal direction. One row is indicated for each light barrier 210 from FIG. 2 in the vertical direction. In the assignment table 400, a white field represents an interrupted flow of light between the corresponding light barrier elements 205 and a black field represents an existing flow of light. The flow of light may be enabled by a recess 305 in the coding disk 230 according to FIG. 3 or, in the case of a reflection light barrier, by a reflective region on the coding disk 230.

The uppermost row illustrated in FIG. 4 corresponds to the least significant binary digit (Least Significant Bits, LSB) of the illustrated code; the significance of the illustrated binary digits increases in the downward direction to the most significant binary digit (Most Significant Bit, MSB) in the fourth row.

The illustrated coding between rotary positions and binary states of the four different light barriers 210 corresponds to a four-bit Gray code. This code is distinguished by the fact that only the state of a single binary digit (bit) changes in each case between adjacent values or rotary positions. In contrast to the conventional dual coding, this dispenses with the need to position the light barrier elements 205 exactly with respect to the coding disk 230 in such a manner that the states of a plurality of light barriers 210 change with respect to the absolutely identical rotary position between adjacent rotary positions of the coding disk 230, which is associated with great practical difficulties.

If the light barriers 210 do not switch at the same angular position when the dual code is used, a result may be read between these two angular positions, which result is corrupted by a value dependent on the sum of the significances of the binary digits to which the switching light barriers 210 are assigned. In the worst case scenario, the error may reach a value of the most significant binary digit, which may amount to half of the range of values of the coding or half the rotary position range, that is to say eight positions. In the case of the Gray coding illustrated in the assignment table 400, only a maximum of one error may arise between adjacent rotary positions of the coding disk 230 as a result of incorrect scanning, which error corresponds to a rotary position.

For further processing of the determined rotary position of the coding disk 230, the Gray code illustrated in FIG. 4 may be converted into a dual code, for example, in a known manner. Conversion is clear and generally known in both directions.

The invention claimed is:

1. An electric hand power tool, comprising: a cylindrical device section, a control element which is movable around the circumference of the cylindrical device section, and an electric scanning apparatus which is arranged on the cylindrical device section and is configured to determine a rotary position of the control element, wherein the scanning apparatus is further configured to optically scan the rotary position, wherein; the control element including a first plurality of position markings along a first circular arc at a first radius and a second plurality of position markings along a second circular arc at a second radius different from said first radius, and the scanning apparatus includes a first number of scanning elements configured to scan position markings on said first circular arc and a different second number of scanning elements configured to scan position markings on said second circular arc, said scanning apparatus configured to determine the rotary position based on signals from the first and second number of scanning elements.

2. The electric hand power tool as claimed in claim 1, wherein the scanning apparatus comprises a plurality of binary scanning elements, each of which is configured to provide a binary digit of a binary coded rotary position of the control element.

3. The electric hand power tool as claimed in claim 2, wherein the rotary position is coded in such a manner that the binary representations of respective adjacent rotary positions of the control element differ in at most one binary digit.

4. The electric hand power tool as claimed in claim 2, wherein the control element has a number of position markings in the shape of a circular arc, each scanning element is configured to scan a position marking assigned to it, and at least two position markings are on the same circumference around an axis of rotation of the control element.

5. The electric hand power tool as claimed in claim 4, further comprising a coding disk which is connected to the control element and which extends in the radial direction with respect to the axis of rotation of the control element, wherein one of the position markings comprises an aperture in the coding disk.

6. The electric hand power tool as claimed in claim 4, further comprising a coding disk which is connected to the control element and which extends in the radial direction to the axis of rotation of the control element, wherein two of the position markings comprise reflective marks on different sides of the coding disk.

7. The electric hand power tool as claimed in claim 1, further comprising a controller which is configured to control an electric drive device of the electric hand power tool on the basis of the rotary position of the control element.

8. The electric hand power tool as claimed in claim 2, wherein the controller and the scanning elements are arranged on a common flat printed circuit board.

9. The electric hand power tool as claimed in claim 1, wherein the cylindrical device section comprises one or more of an electric motor and a planetary transmission.

10. The electric hand power tool as claimed in claim 1, wherein the control element is movable around an axis of rotation which extends parallel to a longitudinal axis of the cylindrical device section.

11. The electric hand power tool as claimed in claim 1, wherein:

said first plurality of position markings includes a first number of position markings at a first circumferential position and a second number of position markings at a second circumferential position offset from said first circumferential position;

said second plurality of position markings includes a first number of position markings at the first circumferential position and a second number of position markings at the second circumferential position; and said first number of scanning elements includes at least one scanning element at said first circumferential position and at least one scanning element at said second circumferential position; and said second number of scanning elements includes at least one scanning element at said first circumferential position and at least one scanning element at said second circumferential position.

12. The electric hand power tool as claimed in claim 1, wherein the electric scanning apparatus is an optical scanning apparatus.

* * * * *